US007369146B2

(12) United States Patent
Maruyama

(10) Patent No.: US 7,369,146 B2
(45) Date of Patent: May 6, 2008

(54) THERMAL PRINTER

(75) Inventor: Takahito Maruyama, Fukushima-ken (JP)

(73) Assignee: Alps Electric Co., Ltd, Tokyo (JP)

( * ) Notice: Subject to any disclaimer, the term of this patent is extended or adjusted under 35 U.S.C. 154(b) by 293 days.

(21) Appl. No.: 11/247,091

(22) Filed: Oct. 6, 2005

(65) Prior Publication Data

US 2006/0082636 A1 Apr. 20, 2006

(30) Foreign Application Priority Data

Oct. 19, 2004 (JP) ..... 2004-303911

(51) Int. Cl.
*B41J 25/304* (2006.01)

(52) U.S. Cl. ..... 347/197; 400/120.16

(58) Field of Classification Search ..... 347/197, 347/198; 400/120.16, 120.17
See application file for complete search history.

(56) References Cited

U.S. PATENT DOCUMENTS 4,739,341 A 4/1988 Matsuno et al.
4,962,387 A 10/1990 Yamamoto et al.
5,144,335 A 9/1992 Maslanka et al.
5,516,219 A 5/1996 Leonard et al.

FOREIGN PATENT DOCUMENTS

JP 2002-120446 4/2002
JP 2002-144616 5/2002

OTHER PUBLICATIONS

Search Report dated May 11, 2006, for corresponding European Patent Application No. 05256144.6.

*Primary Examiner*—Huan Tran
(74) *Attorney, Agent, or Firm*—Brinks Hofer Gilson & Lione

(57) ABSTRACT

In order to provide a thermal printer, which can reliably pressure-contact a recording paper made of thick paper to a platen roller with a small motor and print high quality images, a thermal printer of the invention includes head supporting members, which support a thermal head to head up/down with respect to a platen roller; and a guide member capable of pressure-contacting a recording paper conveyed between the thermal head and the platen roller to the platen roller. The thermal head can head up/down when the head supporting members turn. The guide member is separated from the head supporting members, thereby the guide member ascends and descends with respect to the platen roller by a driving source (not shown) capable of turning the head supporting members.

8 Claims, 3 Drawing Sheets

THERMAL PRINTER

BACKGROUND OF THE INVENTION

1. Field of the Invention

The present invention relates to a thermal printer, and particularly, to a thermal printer, which can print high-quality images by conveying recording media with high accuracy.

2. Description of the Related Art

A thermal printer 31 in the related art will be described on the basis of JP-A-2002-144616. As shown in FIG. 3, the thermal printer 31 is provided with a printer main body 31*a* and a cassette mounting part 31*b* capable of mounting a ribbon cassette 39, to be described below, in the printer main body 31*a*.

In addition, a rotatable platen roller 32 is disposed in the printer main body 31*a*, and a thermal head 33 is disposed above the platen roller 32.

Furthermore, a recording paper 34 is fed between the thermal head 33 and the platen roller 32 so as to be conveyed in a direction of arrow A. The recording paper 34 is made of thick papers such as printing papers, on which color printing can be performed.

Thermal head 33 is supported by a head mounting platen 35, and the head mounting platen 35 is mounted on a head lever.

The head lever is formed in a cantilevered shape, and one end thereof (right side of the drawing) is supported by a supporting shaft 37. The head lever can rotate around the supporting shaft 37 as a fulcrum by a motor acting as a driving source, thereby a free end of the thermal head 33 is attachable to and detachable from (head up/down) the platen roller 32.

In addition, when a ribbon cassette 39, to be described below, is mounted on the cassette mounting part 31*b* in a head-up state of the thermal head 33, an ink ribbon 38 is positioned between the platen roller 32 and the thermal head 33.

The width of the ink ribbon 38 is larger than that of the recording paper 34 so as to be accommodated in the ribbon cassette 39. Both ends of the ink ribbon 38 are wound on a feed reel 39*a* and a take-up reel 39*b*, and the feed reel 39*a* and the take-up reel 39*b* are rotatably supported by side plates 39*c* of the ribbon cassette 39, which face each other.

When the ribbon cassette 39 is mounted on the cassette mounting part 31*b*, the take-up reel 39*b* is engaged with a take-up core (not shown) on the printer main body side so as to rotate in the counter-clockwise direction.

As the take-up reel 39*b* is rotated in the counter-clockwise direction by rotating the take-up core, the ink ribbon 38 wound on the feed reel 39*a* can be wound on the take-up reel 39*b*.

The ribbon cassette 39 is provided with a relief groove 39*d* for relieving a pressure-contact roller 41, to be described below, and a take-up hole 39*e* formed at the lower portion of the relief groove 39*d*. A guide roller 39*f* made of a metal rod is rotatably supported by the side plate 39*c* in the vicinity of the take-up hole 39*e*.

The ink ribbon 38 is detached from a right end of the head mounting platen 35 at a predetermined detachment angle and bent at about right angle at a guide roller 39*f* so as to be wound on the take-up reel 39*b*.

On the left side of the platen roller 32, the fed roller 40 and the pressure-contact roller 41, which is pressure-contacted with the fed roller 40, are disposed. The recording paper 34 is inserted between the fed roller 40 and the pressure-contact roller 41 and conveyed in the direction of arrow A by rotating the fed roller 40 in the counter-clockwise direction.

When the ribbon cassette 39 is mounted on the cassette mounting part 31*b*, the pressure-contact roller 41 is positioned in the relief groove 39*d*.

The head mounting platen 35 is integrally formed with a guide member (not shown), and the recording paper 34 made of thick paper, which is fed between the thermal head 33 and the platen roller 32 during printing, is bent at a predetermined abutting angle $\alpha$ to the platen roller 32 by the guide member.

However, in the thermal printer 31 in the related art, since the head lever is formed in a cantilevered shape, when the thermal head pressure-contacts the recording paper 34 made of thick paper, and the guide member keeps bending the recording paper 34 until the abutting angle reaches $\alpha$, the head lever needs sufficient load to rotate.

For this reason, a motor for turning the head lever 36 should be large, which induces the increase in power consumption.

On the other hand, when a motor is small, even when the guide member (not shown), which is integrally formed with the head mounting platen 35, pressure-contacts the recording paper 34 to the platen roller 32 so as to bend the recording paper 34 at the abutting angle $\alpha$, the recording paper 34 made of thick paper is prone to return to the original shape due to the resilient force of the recording paper 34. Therefore, the thermal head 33 in a head-down state can not reliably pressure-contact the recording paper 34 to the platen roller 32, and high quality image printing cannot be achieved.

SUMMARY OF THE INVENTION

The present invention has been finalized in view of the drawbacks inherent in the thermal printer according to the related art, and it is an object of the invention to provide a thermal printer, which can pressure-contact a recording paper made of thick paper to a platen roller with a small motor and thus print high quality images.

A thermal printer according to a first aspect of the invention in order to achieve the object includes a thermal head; a platen roller, which the thermal head is attachable to and detachable from (head up/down); head supporting members, which support the thermal head to head up/down with respect to the platen roller; and a guide member capable of pressure-contacting a recording paper conveyed between the thermal head and the platen roller to the platen roller. The thermal head can head up/down when the head supporting members turn, and the guide member is separated from the head supporting members. Therefore, the guide member individually ascends and descends with respect to the platen roller by a driving source capable of rotating the head supporting members.

In a thermal printer according to a second aspect of the invention in order to achieve the object, a first driving member capable of heading the thermal head up/down is connected with the driving source, and the head supporting members can be rotated when the first driving member presses a portion, on which the thermal head is mounted.

In a thermal printer according to a third aspect of the invention in order to achieve the object, the guide member can ascend and descend with respect to the platen roller by a second driving member connected with the first driving member.

In a thermal printer according to a fourth aspect of the invention in order to achieve the object, the head supporting members can be rotated via a pressure-contact sheet disposed between the head supporting members and the first driving member, and a first elastic member, which urges the head supporting members and the pressure-contact sheet away from each other, is disposed between the head supporting members and the pressure-contact sheet, thereby the head supporting members turn via the first elastic member when the first driving member presses the pressure-contact sheet.

In a thermal printer according to a fifth aspect of the invention in order to achieve the object, the first driving member is formed with a first cam capable of pressing the pressure-contact sheet and a first gear composed of spur gears, parts of tooth peaks of which are notched, and the second driving source is formed with a second cam, which can pressure-contact, ascend and descend the guide member, and a second gear engaged with the first gear. When the first driving member is turned by the driving source, the second gear rotates so as to turn the second cam, and then the guide member ascends and descends.

In a thermal printer according to a sixth aspect of the invention in order to achieve the object, an operating pin pressingly operated by the second cam is formed in the guide member, and the operating pin is fitted with a slide groove formed at a holder member supporting a driving shaft connected with the driving source, thereby the guide member can ascend and descend.

In a thermal printer according to a seventh aspect of the invention in order to achieve the object, a pair of rotatable guide rollers is disposed at the upstream and downstream of a conveyance direction of the recording paper with the platen roller interposed therebetween in the guide member.

In a thermal printer according to an eighth aspect of the invention in order to achieve the object, a second elastic member, which urges the guide member elastically away from the platen roller, is disposed in the guide member.

In a thermal printer according to a ninth aspect of the invention in order to achieve the object, the recording paper, which is pressure-contacted to the platen roller by the guide member, is bent at a predetermined abutting angle with respect to the platen roller.

In the thermal printer of the present invention, the guide member is independent of the head supporting members, and the guide member individually ascends and descends with respect to the platen roller by a driving source capable of turning the head supporting members. Therefore, the thermal head can be sufficiently pressed against the recording paper with a driving source having small driving force, and the recording paper made of thick paper can be bent at a predetermined abutting angle $\alpha$ by the guide member.

For this reason, a driving source of low power consumption can be realized, and high quality image printing can be performed.

Furthermore, the first driving member capable of heading the thermal head to up/down is connected to the driving source. The head supporting members can be rotated since a portion of the head supporting member, on which the thermal head is mounted, is pressed on the first driving member. Therefore, the head up/down operation of the thermal head can be performed with a driving source having small driving force, and the thermal head can reliably head up/down with a small driving source.

Furthermore, the head supporting member can be rotated via the pressure-contact sheet disposed between the head supporting member and the first driving member. The first elastic member is disposed between the head supporting members and the pressure-contact sheet, and the first elastic member urges the head supporting members and the pressure-contact sheet to depart from each other. When the first driving member presses the pressure-contact sheet, the head supporting members turn via the first elastic member. Therefore, with one driving source, the thermal head can head down while the guide member is independently descended to the platen roller, thereby the recording paper is pressure-contacted at the abutting angle $\alpha$.

For this reason, by applying only small pressure to the thermal head in the head-down state, the recording paper can be reliably pressure-contacted with the platen roller, which leads to high quality image printing.

In addition, when the first driving member is turned by the driving source, the second gear rotates and the second cam turns, so that the guide member ascends and descends. Therefore, the driving of the driving source can be reliably applied to the second driving member, and the guide member descends by the second driving member before the thermal head heads down. Thus, the conveyed recording paper can be reliably pressure-contacted with the platen roller forming the abutting angle $\alpha$.

The operating pin pressingly operated by the second cam is formed in the guide member, and the operating pin is fitted with the slide groove formed at the holder member supporting the driving shaft connected with the driving source, thereby the guide member can ascend and descend. Therefore, as the second driving member reliably moves the guide member down, the recording paper can be reliably pressure-contacted to the platen roller.

The pair of rotatable guide rollers is disposed at the upstream and downstream in a conveyance direction of the recording paper with the platen roller interposed therebetween in the guide member. Thus, the recording paper can be pressure-contacted to the platen roller at the abutting angle $\alpha$.

The second elastic member is disposed in the guide member, and the second elastic member urges the guide member in a direction away from the platen roller. Therefore, the guide member and thermal head are estranged from the platen roller at all times except printing operation.

The recording paper, which is pressure-contacted to the platen roller by the guide member during printing, is bent at a predetermined abutting angle with respect to the platen roller. Therefore, even though a small pressure is applied to the thermal head in the head-down state, the recording paper can be reliably pressure-contacted to the platen roller. For this reason, high quality image printing can be performed.

DETAILED DESCRIPTION OF THE PREFERRED EMBODIMENTS

Figure 1:
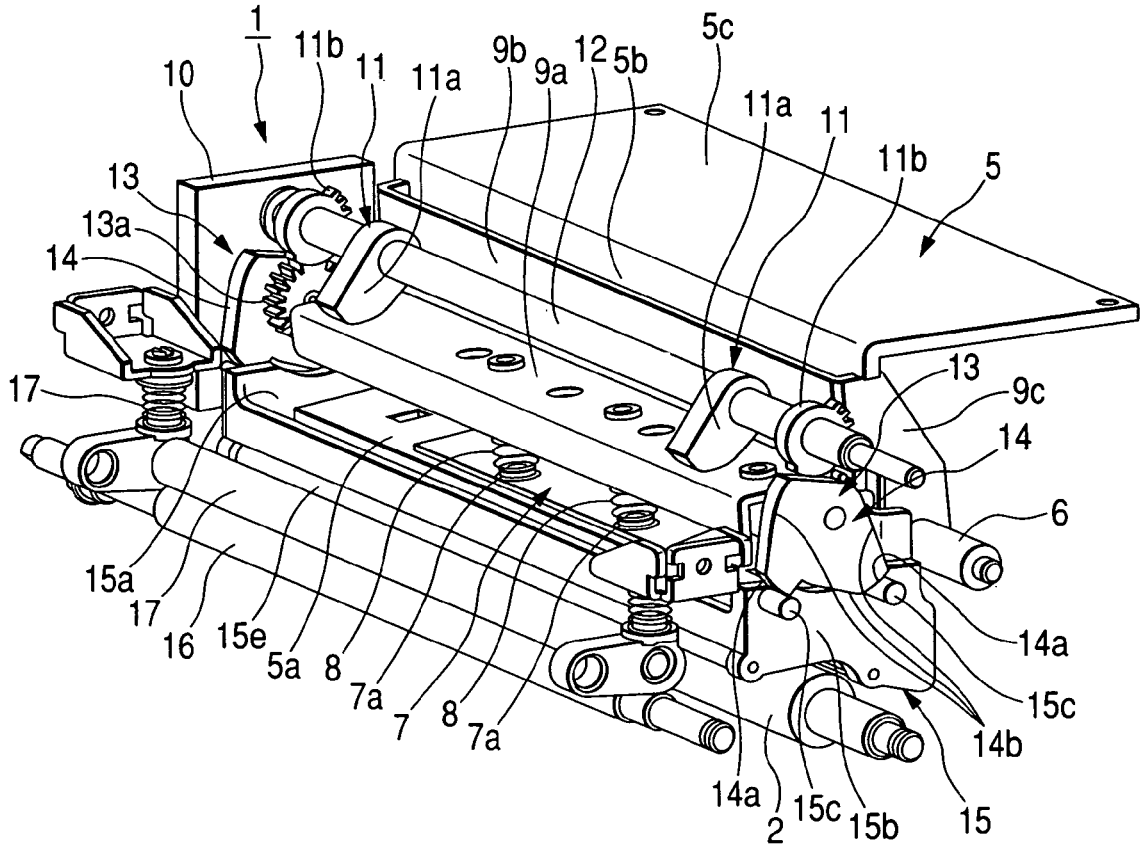
FIG. 1 is a perspective view of a thermal printer of the present invention.
Figure 2:
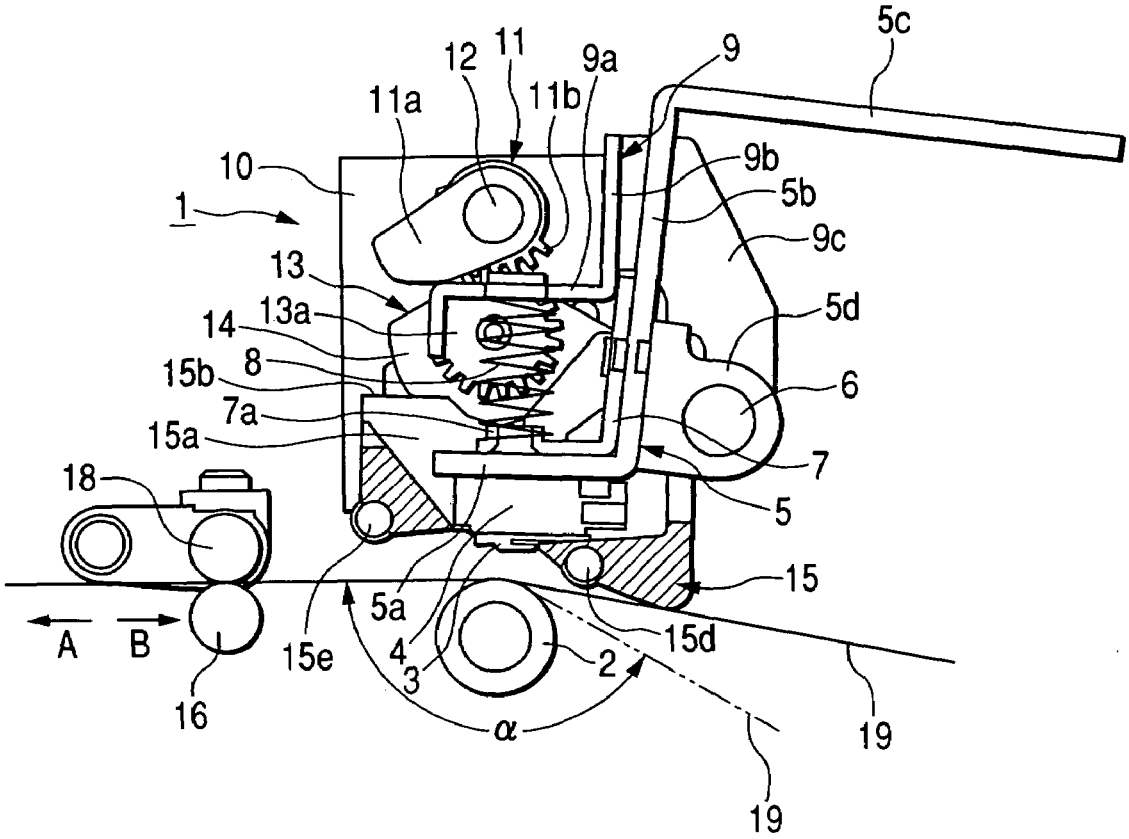
FIG. 2 is a cross-sectional view of essential parts of the thermal printer in FIG. 1.
Figure 3:
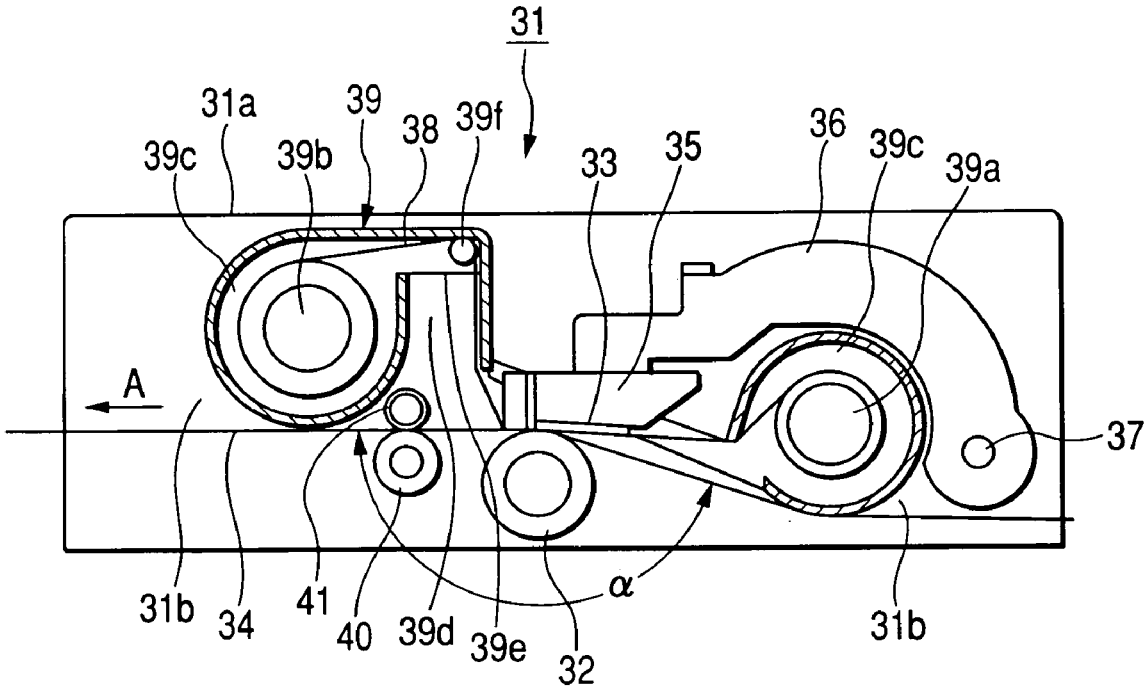
FIG. 3 PRIOR ART
FIG. 3 is a side view of a thermal printer in the related art.

Hereinafter, an embodiment of a thermal printer of the invention will be described with reference to FIGS. 1 and 2. FIG. 1 is a perspective view of the thermal printer of the invention, and FIG. 2 is a cross-sectional view of essential parts of the thermal printer in FIG. 1.

The thermal printer 1 of the invention is provided with a cylindrical platen roller 2 disposed at the lowest part; and a thermal head 3 disposed above the platen roller 2. The thermal head 3 is composed of a line head elongated forward and backward in FIG. 1 and mounted on a head supporting member 5 via a head mounting platen 4.

The head mounting member 5 is composed of a head supporting part 5*a*, on which the head mounting platen 4 is mounted, a rear part 5*b* bending upward at the right side of the head supporting part 5*a* (in the drawing), and a heat sink part 5*c* bending right (in the drawing) at the upper end of the rear part 5*b*.

In addition, the rear part 5*b* is formed with a bearing 5*d*, which protrudes outward (the right side in the drawing), and the bearing 5*d* is supported by a rod-shaped supporting shaft 6. For this reason, the head supporting member 5 can rotate around the supporting shaft 6.

An L-shaped spring supporting plate 7 is mounted on the head supporting member 5, and a first elastic member 8 composed of a helical compression spring is supported by a spring supporting unit 7*a* of the spring supporting plate 7. In addition, an upper end of the first elastic member 8 elastically urges a pressure-contact sheet 9. The pressure-contact sheet 9 is formed with a pressure-contact part 9*a*, which is elastically urged by the first elastic member 8; a rear part 9*b*, which bends upward at the right side of the pressure-contact part 9*a*; and a bearing 9*c*, which is formed by bending both of front and rear ends (shown in FIG. 1) of the rear part 9*b* outward.

The bearing 9*c* of the pressure-contact sheet 9 is supported by the supporting shaft 6, which also supports the head supporting member 5.

In addition, both ends of the supporting shaft 6 and a drive shaft 12, which forms a first driving member 11 capable of turning the head supporting member 5, are supported by the holder member 10. The first driving member 11 is provided with a first cam 11*a* shaped like a circular arc and a first gear 11*b* composed of spur gears, parts of tooth peaks of which formed at an outer circumference of the driving shaft 12 that is a given distance away from the first cam 11*a* are notched.

A pair of the first driving member 11 is formed at both ends of the driving shaft 12 in front and rear directions, and the pressure-contact sheet 9 can be pressed by the pair of the first cams 11*a*.

The driving shaft 12 is connected with a driving source composed of a motor or the like, and can be swing right and left to a given degree. Furthermore, a second driving member 13 is rotatably disposed in the holder member 10 of at a lower portion of the driving shaft 12.

The second driving member 13 is composed of a second gear 13*a* and a second cam 14. The second gear 13*a* is engaged with the tooth peaks of the first gear 11*b*, and the second cam 14 integrates the second gear 13*a* with an adhesive or the like. The second cam 14 is formed with two pressure-contact part 14*a*, which is distant from the center of rotation, and relief parts 14*b*, which is close to the center of rotation and formed at a portion between the pressure-contact parts 14*a* and the other portions.

A guide member 15 made of resin materials is disposed at the outer circumference of the head mounting part 5*a* of the head supporting member 5 to surround the head mounting part 5*a*.

A hollow part 15*a*, in which the head mounting part 5*a* of the head supporting member 5 is located, is formed in the guide member 15, and a lower portion of the hollow part 15*a* of the guide member 15 is open, through which the thermal head 3 is exposed.

In addition, a pair of operating pins 15*c* protrudes outward respectively from a pair of side walls 15*b* facing each other with the hollow part 15*a* of the guide member 15, shown in FIG. 1, interposed therebetween. Furthermore, the holder member 10 is disposed at the outside facing the side wall 15*b* of the guide member 15, and a slide groove (not shown), in which the pair of operating pins 15*c* can be engaged and slide, is formed at the holder member 10.

Since the guide member 15 is separated from the head supporting member 5 supporting the thermal head 3, the guide member 15 does not move when the thermal head 3 is moved for adjustment at the time of assembling adjustment, in which the thermal head 3 is matched with the platen roller 2, thereby the guide member 15 can be assembled satisfactorily.

In addition, a first guide roller 15*d* and a second guide roller 15*e* are rotatably disposed at the right side (in the drawing) of the thermal head 3, which is exposed downward from the hollow part 15*a*, and at the left side (in the drawing) of the thermal head 3 respectively on the bottom surface of the guide member 15.

The guide member 15 is elastically urged away from the platen roller 2 at all times by a second elastic member (not shown). Therefore, when the operating pin 15*c* is located at the relief part 14*b* of the second cam 14, the guide member 15 is positioned at an ascending location, which is away from the platen roller 2, as shown in FIG. 2.

At the same time, the thermal head 3 is headed up by the ascending guide member 15.

Furthermore, a paper feed roller 16 and a pressure-contact roller 18, which is pressed to the paper feed roller 16 by a coil spring 17, are disposed at the left side (in the drawing) of the platen roller 2.

In addition, a recording paper 19 made of thick paper such as print paper, on which color printing can be performed, is conveyed between the thermal head 3 in the head-up state and the platen roller 2 from the right side (in the drawing) of the platen roller 2 and pressure-inserted between the paper feed roller 16 and the pressure-contact roller 18 so as to be conveyed in a direction of either A and B.

When the thermal printer 1 of the present invention is a thermal transfer printer, an ink ribbon (not shown) is disposed above the recording paper 19 between the thermal head 3 in the head-up state and the platen roller 2.

The ink ribbon adhered to the recording paper 19 during printing is detached from the recording paper by the first guide roller 15*e* so as to be conveyed in the left (in the drawing) direction.

Hereinafter, the operations of the thermal printer 1 of the invention will be described. In an initial state, the thermal head 3 is in the head-up state, and the guide member 15 ascends so as to be separated from the platen roller 2.

The recording paper 19 is conveyed in A direction from the right side (in the drawing) between the thermal head 3 and the guide member 15 in the initial state, and the platen roller 2, and then the recording paper 19 is cued.

When the recording paper 19 is cued, the driving shaft 12 is rotated in the counter-clockwise direction by a motor serving as a driving source.

Then, the first cam 11*b* rotates in the counter-clockwise direction, the same direction as that of the driving shaft 12, and the second gear 13*a* engaged with the first gear 11*b* rotates in the clockwise direction, thereby the second cam 14 rotates in the clockwise direction.

In addition, the operating pin 15*c* located in the relief part 14*b* of the second cam 14 is pressed to the pressure-contact part 14*a* of the second cam 14, and the guide member 15 individually descends so as to pressure-contact the recording paper 19 to the platen roller 2.

At this time, the recording paper is pressed to the first and second guide roller 15*d* and 15*e* at an abutting angle α to the platen roller 2, thereby the recording paper 19 is reliably adhered to an outer circumference of the platen roller 2.

After that, as the first cam 11*a* presses the pressure-contact part 9*a* of the pressure-contact sheet 9 downward, the head mounting part 5*a* of the head supporting member 5 is pressed downward via the first elastic member 8. At this time, the head supporting member 5 and the pressure-contact sheet 9 rotate around the supporting shaft 6 in the counter-clockwise direction.

In this way, the thermal head 3 heads down so as to be pressure-contacted to the platen roller 2 via the ink ribbon and the recording paper 19.

In this state, when the recording paper 19 is a thermal paper, the recording paper 19 develops color and prints images by selectively turning on a plurality of light emitting elements of the thermal head 3 on the basis of printing information.

In a thermal transfer printer using an ink ribbon for color printing, an ink of the ink ribbon of a first color is transferred, and a first color image is transferred to the recording paper 19. After that, the guide member 15 ascends, and the thermal head 3 heads up, thereby the recording paper 19 is fed backward in B direction.

Also, the recording paper 19 is cued again, and the thermal head 3 is headed down, thereby a second color image is printed on the first color image.

Desired color images can be printed on the recording paper 19 by performing the above operation repeatedly.

In the thermal printer 1 of the invention, the guide member 15 individually descends before the thermal head 3 heads down, and pressure-contacts the recording paper 19 made of thick paper to the platen roller 2 at the abutting angle α, thereby the resilient force of the recording paper 19 bent at the abutting angle α is not applied to the thermal head 3 in the head-down state.

Therefore, even when the pressing force, with which the thermal head 3 is headed down, is small, high quality image printing can be performed on the recording paper 19.

The invention claimed is:

1. A thermal printer comprising:

a thermal head;

a platen roller, which the thermal head is attachable to and detachable from (head up/down);

head supporting members, which support the thermal head to head up/down with respect to the platen roller; and a guide member capable of pressure-contacting a recording paper conveyed between the thermal head and the platen roller to the platen roller, wherein the thermal head can head up/down when the head supporting members turn, and the guide member is separated from the head supporting members, such that the guide member ascends and descends with respect to the platen roller urged by a driving source capable of rotating the head supporting members; a first driving member capable of heading the thermal head head up/down is connected with the driving source, and the head supporting members are rotatable when the first driving member presses a structure on which the thermal head is mounted.

2. The thermal printer according to claim 1, wherein the guide member can ascend and descend with respect to the platen roller by a second driving member connected with the first driving member.

3. The thermal printer according to claim 2, wherein the first driving member is formed with a first cam capable of pressing the pressure-contact sheet and a first gear composed of spur gears, part of tooth peaks or which are notched, and the second driving source is formed with a second cam, which can pressure-contact, ascend and descend the guide member, and a second gear engaged with the first gear, thereby when the first driving member is turned by the driving source, the second gear rotates so as to turn the second cam, and then the guide member ascends and descends.

4. The thermal printer according to claim 3, wherein an operating pin pressingly operated by the second cam is formed in the guide member, and the operating pin is fitted with a slide groove formed at a holder member supporting a driving shaft connected with the driving source, thereby the guide member can ascend and descend.

5. The thermal printer according to claim 1, wherein the head supporting members can be rotated via a pressure-contact sheet disposed between the head supporting members and the first driving member, and a first elastic member, which urges the head supporting members and the pressure-contact sheet away from each other, is disposed between the head supporting members and the pressure-contact sheet, thereby the head supporting members turn via the first elastic member when the first driving member presses the pressure-contact sheet.

6. The thermal printer according to claim 1, wherein a pair of rotatable guide rollers is disposed at the upstream and downstream of a conveyance direction of the recording paper with the platen roller interposed therebetween in the guide member.

7. The thermal printer according to claim 1, wherein an elastic member, which urges the guide member elastically away from the platen roller, is disposed in the guide member.

8. The thermal printer according to claim 1, wherein the recording paper, which is pressure-contacted to the platen roller by the guide member, is bent at a predetermined abutting angle with respect to the platen roller.

* * * * *